US010368647B2

(12) United States Patent
Schenck

(10) Patent No.: US 10,368,647 B2
(45) Date of Patent: Aug. 6, 2019

(54) BACKREST FOR A SEATING DEVICE

(71) Applicant: Kirk Edward Schenck, Los Angeles, CA (US)

(72) Inventor: Kirk Edward Schenck, Los Angeles, CA (US)

( * ) Notice: Subject to any disclaimer, the term of this patent is extended or adjusted under 35 U.S.C. 154(b) by 0 days.

(21) Appl. No.: 15/774,694

(22) PCT Filed: Nov. 15, 2016

(86) PCT No.: PCT/US2016/062094
§ 371 (c)(1),
(2) Date: May 9, 2018

(87) PCT Pub. No.: WO2017/087418
PCT Pub. Date: May 26, 2017

(65) Prior Publication Data

US 2018/0368579 A1 Dec. 27, 2018

Related U.S. Application Data

(60) Provisional application No. 62/256,074, filed on Nov. 16, 2015.

(51) Int. Cl.
*A47C 7/46* (2006.01)
*A47C 7/40* (2006.01)

(52) U.S. Cl.
CPC ..... *A47C 7/467* (2013.01); *A47C 7/40* (2013.01); *A47C 7/462* (2013.01)

(58) Field of Classification Search
CPC ..... A47C 7/467; A47C 7/462; A47C 7/40
(Continued)

(56) References Cited

U.S. PATENT DOCUMENTS 2,988,398 A 6/1961 Hamilton
3,663,055 A * 5/1972 Gale ..... A47C 4/022 297/440.2

(Continued)

FOREIGN PATENT DOCUMENTS

GB 1139173 5/1966

OTHER PUBLICATIONS

Yoo, Won-Gyu, Chung-Hwi Yi, and Heon-Seock Cynn. "Effects of the Height of Ball-Backrest on Head and Shoulder Posture and Trunk Muscle Activity in VDT Workers." Industrial Health 46 (2008): 289-97. ResearchGate. Web. <https://www.researchgate.neVpublication/5312170 _Effects_ of _the_Height_of _Ball-Backrest_ on_Head_and_Shoulder _Posture _and_ Trunk_Muscle _ Activity _in_ VDT_ Workers>.

(Continued)

*Primary Examiner* — Anthony D Barfield
(74) *Attorney, Agent, or Firm* — Eandi Fitzpatrick LLP; William Fitzpatrick

(57) ABSTRACT

A seating device and seating device backrest are described. The seating device and backrest have a seat portion dimensioned for an occupant; a support arm coupled to seat portion proximate a first end of the support arm; a mounting receptacle coupled to the support arm proximate a second end of the support arm, wherein the mounting receptacle is configured to accept a substantially convex body, and wherein the support arm is configured to position the mounting receptacle at an angle such that the convex body makes focal contact at an seat occupant's optimally concave lumbar/thoracic spinal regions.

15 Claims, 16 Drawing Sheets

(58) Field of Classification Search
USPC ..... 297/440.2
See application file for complete search history.

(56) References Cited

U.S. PATENT DOCUMENTS

| | | | | |
|---|---|---|---|---|
| 4,169,625 | A * | 10/1979 | Petersen | A47C 4/02 297/440.2 |
| D728,293 | S | 5/2015 | Schenck | |
| 2010/0314916 | A1 | 12/2010 | Walser | |

OTHER PUBLICATIONS

Yoo, Won-Gyu, Chung-Hwi Yi, and Min-Hee Kim. "Effects of a Ball-backrest Chair on the Muscles Associated with Upper Crossed Syndrome When Working at a VDT" Work 29 (2007): 239-44. 10S Press. Web.

* cited by examiner

BACKREST FOR A SEATING DEVICE

CROSS-REFERENCE TO RELATED APPLICATIONS

The present utility patent application claims the priority benefit of the U.S. provisional application for patent Ser. No. 62/256,074 filed on Nov. 16, 2015, entitled A Spherical Seating Device Backrest.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

The present invention relates generally to seating devices. More particularly, the present invention relates to ergonomically designed seating devices.

BACKGROUND OF THE INVENTION

Conventional seating devices typically have some variant of a vertical planar backrest with a surface applying support pressure to large contact planes on a seat occupant's thoracic and cervical back regions to assist in maintaining an upright sitting position. These backrest surfaces are typically flat or slightly molded to conform to the shape of a seat occupant's entire back. Most seat occupants tend to bend their spine in a convenient but unhealthy convex protruding manner against the conventional backrest.

To enhance comfort, improve posture, and induce healthy seating habits, seating device backrests exist with slightly convex contact planes, or separate embedded protruding structural elements, or attachments, supporting sustained pressure on a seat occupant's (a) "spinal" lumbar/thoracic region along the vertical center of the back, and (b) "muscular" lumbar/thoracic region radiating outward from the "spinal" region to the extremities of the back and housing the primary back muscles. Typical prior art lumbar supportive backrests with lumbar supports comprise a cushioned attachment or embedded backrest element, or otherwise form an extremity pressure element anchored to a framework within or connected to the seating device's larger traditional vertical planar backrest. These devices restrict horizontal flexibility and lateral maneuverability of a seat occupant by contacting and restricting movement of large planar sections of a seat occupant's back.

Further, these prior art devices apply wide planes of horizontal pressure necessitated by the requirement they conform to, or comprise part of, the broader seating device backrest elements, or because they are designed following a premise that the best mechanism to support a seat occupant's body is to apply pressure to both the skeletal middle and muscular extremities of the lumbar/thoracic back regions. But, this pressure to the muscles in the lumbar and upper thoracic back regions, and the resultant reduction of back muscle blood flow, are the most common sources of chronic pain, discomfort and long term back injury for people who often sit in seating devices for long periods of time on a daily basis.

While designed to encourage a seat occupant to adopt a healthy seating posture, prior art lumbar supports, and the seat backrests including them, are limited in the flexibility and maneuverability they offer a seat occupant because their intended contact points apply broad planar pressure across most or all of a seat occupant's proximal thoracic and lumbar regions' muscle, ligament and tendon tissues protruding and radiating out from the spinal center of the back to the back's horizontal extremities. Because these prior art lumbar supports apply a generalized rectangular pressure to large planar sections of a seat occupant's entire spinal and muscular lumbar and thoracic hack regions, (a) they reduce needed muscular blood-flow and oxygenation and cause pressure contact injury to the lumbar muscles, ligaments and tendons, and (b) they offer the seat occupant the comfortable option to slouch against, or avoid, the lumbar supports and bypass the beneficial posture improving elements of the supports.

Accordingly, a seating device and backrest is needed that obviates the problems associated with past devices.

SUMMARY OF THE INVENTION

It is an object of the present invention to provide a seating device and seating device backrest that makes primary focal contact with, and applies supportive pressure to, a seat occupant's central spinal (as opposed to muscular) lumbar/thoracic regions best capable of absorbing and tolerating such pressure, with a pivot-like contact that avoids pressure to, and allows 360-degree flexibility and range of motion adjustment of, a seat occupant's muscles in their back's lumbar/thoracic regions, and enables the stabilization of the seat occupant's gluteal buttocks, and sacral spinal, regions in a fixed position relative to the seating device seat cushion.

It is also an object of the present invention to provide a lumbar supportive backrest element that cannot be cheated around or avoided without discomfort or instability, leaving the seat occupant little choice but to maintain optimal posture while seated.

It is a further object of the present invention to provide a stabilized backrest for a seating device that, despite a seat occupant's application of backward pressure from multiple angles, maintains a constant, stabilized resistance pressure toward the back's spinal center thoracic and lumbar regions.

It is an additional object of the present invention to provide a backrest arm rigidly fixed on one end to a seating device seat, and rigidly fixed on the other end to a adjustable stabilized backrest comprising at least an inflated pneumatic, or liquid or solid-filled, compressible body with front (i.e., seat occupant facing) and side facing surfaces being substantially convex or spherical prior to compression by a seat occupant's back, and whose rear facing surface may comprise various shapes such as, without limitation, (1) a spherical shape attached and stabilized to the backrest arm by a plurality of connecting elements and/or a mounting receptacle, or (2) a flat or angled plane attached and stabilized to the backrest arm by a plurality of connecting elements and/or a mounting receptacle.

The present invention mitigates the disadvantages of conventional seating device lumbar supportive backrests that (a) apply pressure to most of, or the entire, linear plane of the seat occupant's muscular lumbar and thoracic regions, and (b) allow a seat occupant to easily and comfortably select unhealthy (slouching) seating positions that bypass the lumbar supportive backrest elements.

By lodging appropriate portions of the sacral and lower lumbar regions of the back (at and just above the coccyx bone) under the convex member of the present invention, and allowing the upper spinal lumbar and thoracic regions of the back to rest along the apex of a chosen convex shape (e.g., hemisphere) of the convex member of the present invention, a seat occupant conforms the spinal lumbar/thoracic region into an optimal, healthy seating posture without placing pressure directly and primarily on the lumbar/thoracic back muscles. By placing the gluteal buttocks, and spinal sacral regions at a plurality of positions on or abutting the forward-facing upper quadrant of the spherical body element of the present invention, thereby slightly lifting the spinal sacral and gluteal buttocks regions into an upward angle relative to the seat cushion, the present invention provides upright balance and maneuvers a seat occupant's spine and back muscles into optimal postural alignment.

It is a further object of the present invention to ensure a seat occupant sits by placing their gluteal buttocks and sacral spinal regions abutted against, or on, the upper forward-facing quadrant of the backrest when the backrest is lowered into its lowest position where it rests at the top of the seating device's seating cushion.

In an embodiment of the present invention, a seating device is provided comprising a seat portion dimensioned for an occupant; a support an coupled to seat portion proximate a first end of the support arm; and a mounting receptacle coupled to the support arm proximate a second end of the support arm, wherein the mounting receptacle is configured to accept a substantially convex body and wherein the support arm is configured to position the mounting receptacle at an position and angle such that the convex body makes focal contact at a seat occupant's optimally concave lumbar or thoracic spinal region.

Other objects and advantages of this invention will become apparent from the following description taken in conjunction with the accompanying drawings wherein are set forth, by way of illustration and example, certain embodiments of the invention.

BRIEF DESCRIPTION OF THE DRAWINGS

It will be understood that such drawings depict preferred embodiments of the invention and, therefore, are not to be considered as limiting their scope with regard to other embodiments that the invention is capable of taking. Accordingly;

FIG. 11(*b*) is a back facing view of various components of a spherical body of an optional embodiment of the present invention.

DETAILED DESCRIPTION OF THE INVENTION

Figure 1:
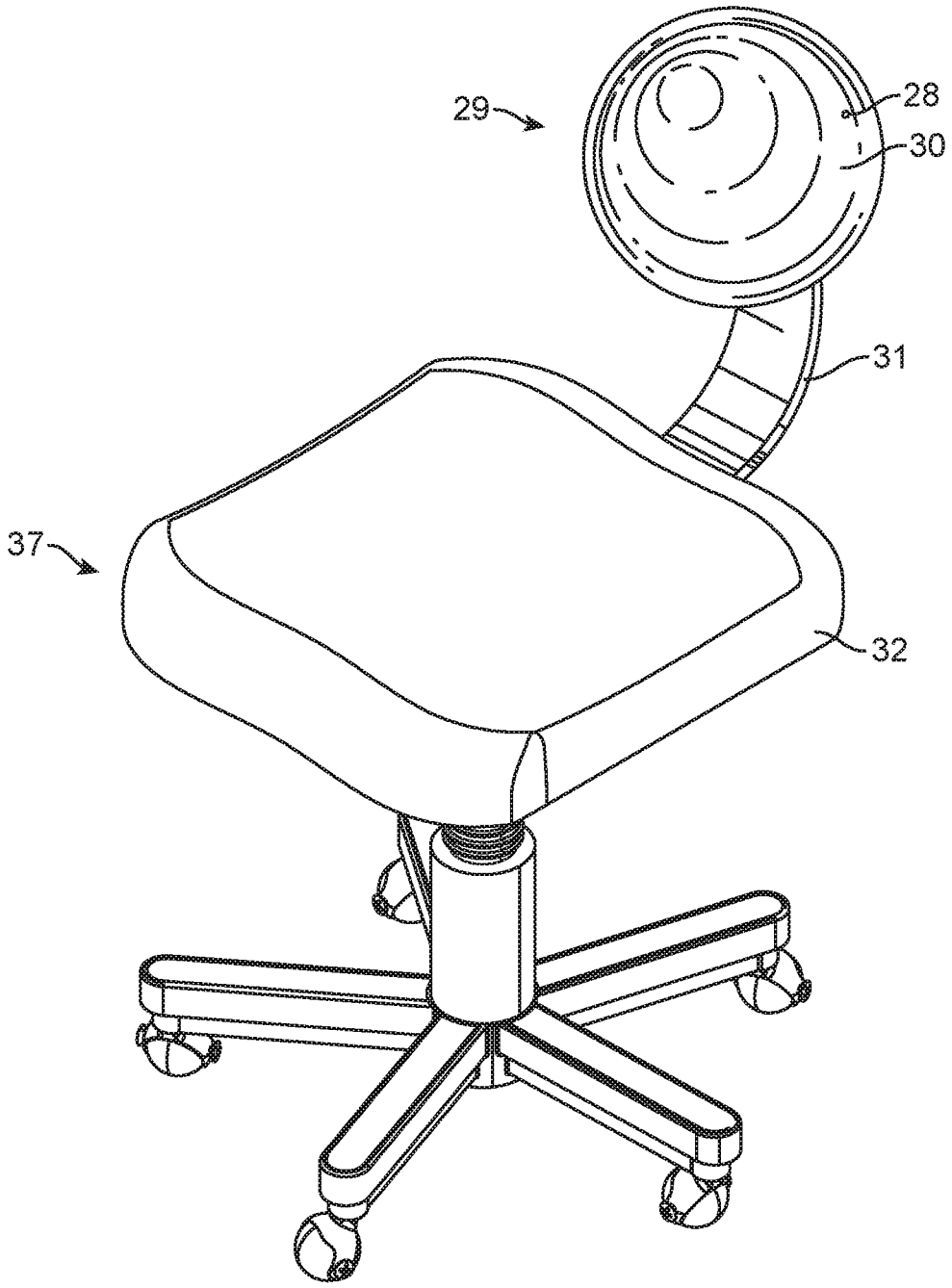
FIG. 1 is a perspective view of a seating device backrest according to a preferred embodiment of the present invention.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and optional embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the," include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means, and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred or optional methods, techniques, devices, embodiments, options, and materials are described, although any methods, techniques, devices, embodiment, option or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

With reference to the FIGS. generally, in embodiments of the present invention, a stabilized backrest 29 primarily comprising a convex body 25, 30 made of expandable or inflatable material is provided. This material may comprise rubber, silicon or other similarly flexible material, and is variably pressure-filled with a liquid, gas or solid to produce the backrest expansion, stability and deformable surface pressure. The body 25, 30 is compressed when its forward-facing convex hemisphere contacts a seat occupant's optimally concave spinal lumbar/thoracic back regions.

The body 25, 30 conforms to, and encourages, an ergonomically desired concave spinal posture position at the desired and optimal point of contact with the spinal lumbar/thoracic back regions. When seated, a seat occupant's optimally concave spinal lumbar/thoracic or thoracic back region makes a pivot contact with the body's 25, 30 convex protruding surface. The body 25, 30 may in various embodiments be covered for utilitarian purposes with rubber, foam, cloth, leather, vinyl, fabric, silicon sheathing or cushion-like materials to increase surface tension at point of contact to better enable stability and adhesion between the seat occupants' back and the backrest's body. In optional embodiments of the present invention, the body 25, 30 and backrest 29 are spherical, while in other embodiments, any shape that conforms to, and encourages, an ergonomically desired concave spinal posture position may be employed.

It is another object of the present invention to provide a stabilized backrest 29 with a body 25, 30 stabilized by a mounting receptacle 17 connected to a rigid support arm 31, 40, 41 that may comprise a plurality of portions. Such rigid support arm 31, 40, 41 is preferably structured with sufficient rigidity and flexural strength such that when a seat occupant's concave spinal lumbar/thoracic regions are aligned with, and apply pressure to, the substantially convex seat-facing contact area of the backrest 29, a seat occupant can achieve optimal lumbar/thoracic back support along a plurality of contact pivot points along the concave lumbar/thoracic spine region of the back and limit the application of oxygen-depriving pressure to the muscles located at the extremities in such back regions.

In an embodiment, the backrest 29 may be coupled to a support arm 31, 40, 41 with a bearing, hinge or other connecting element 18 that rotates, thereby allowing a seat occupant to adjust the angle 16 of the backrest convex body 25, 30 for a specific body size, and modulate the locus at which the spinal lumbar/thoracic regions' preferred concave shape makes contact with the selected convex member hemisphere, or seat occupant facing section, of the backrest 29.

In another optional embodiment, the backrest 29 may be lowered to a lowest point (described in greater detail with reference to FIG. 15) at which it makes contact with the top of seating device's 37 horizontal seat 32 that is preferably made of coarse fabric or leather, or rubberized material, or covered with a material likely to adhere to the seat occupant's legs to maintain the legs' static focal contact with the seat 32 thereby stabilizing the seat occupant's legs and enabling a seat occupant to comfortably stabilize their gluteal buttocks, and sacral spinal, regions on the upper forward-facing quadrant of the backrest 29, which in turn lifts the sacral spinal and gluteal buttocks regions into an upward angle relative to the seat 32 providing upright balance and maneuvering a seat occupant's spinal and muscular back regions into an optimal, healthy and comfortable alignment.

It will nevertheless be understood that no limitation of the scope of the invention is thereby intended. Alterations, further modifications, and other embodiments of the inventive features illustrated in an embodiment of the invention in FIGS. 1-7, an optional embodiment in FIG. 8, and a further optional embodiment in FIGS. 9-15, and additional applications of the principles of the invention as illustrated, which would occur to one skilled in the relevant art and having possession of this disclosure, are to be considered within the scope of the current invention. All references to "spherical" or "convex" contained in these Patent Application Specifications are to mean, as applicable, "substantially spherical" or "substantially convex" in shape across a plurality of seat occupant facing hemispheres of the object or device described.

Figure 4:
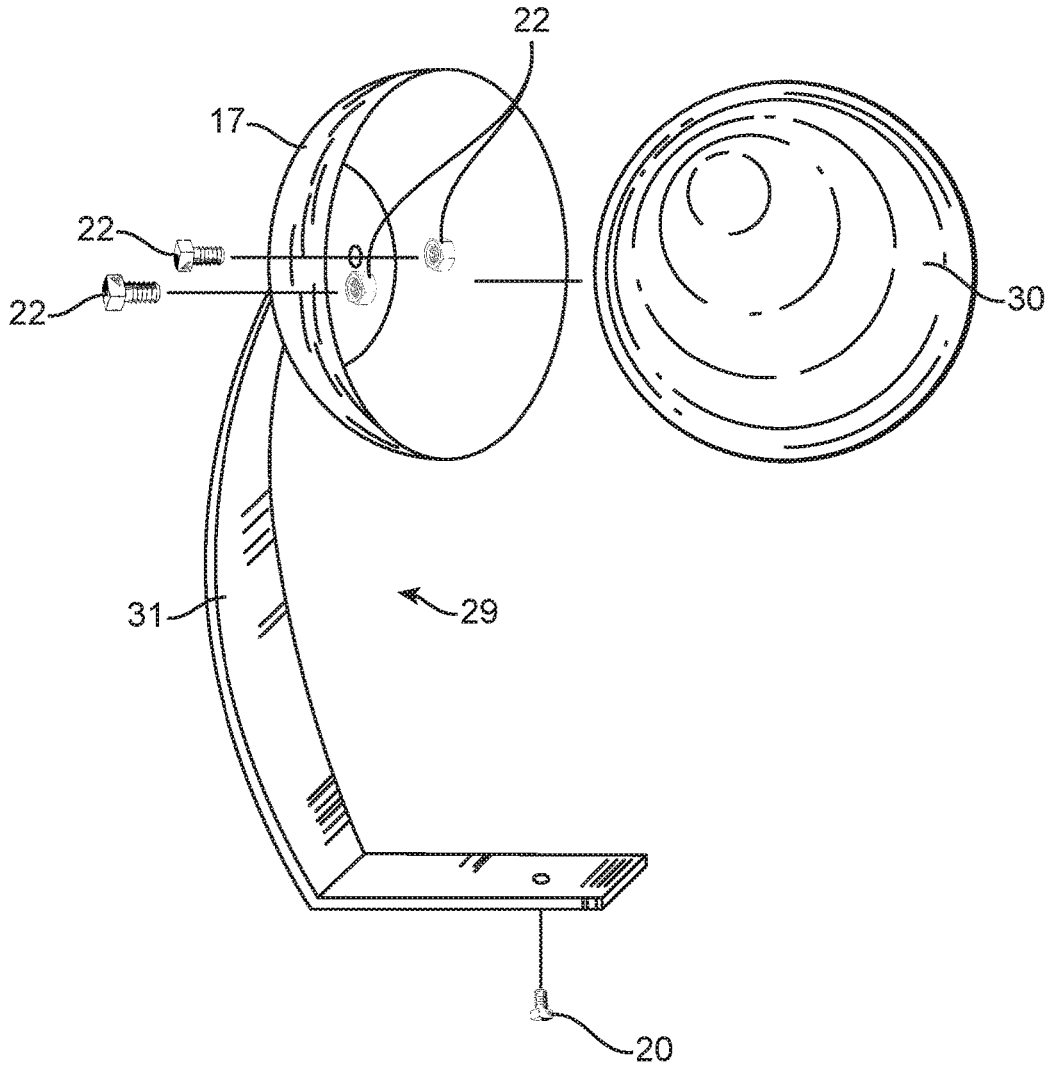
FIG. 4 is an exploded perspective view of a seating device backrest according to a preferred embodiment of the present invention.

With reference to FIG. 1, the seating device backrest (also referred to as "backrest", alone) 29 comprises a substantially convex body 30, a mounting receptacle 17, only the edge being shown, the receptacle 17 being more clearly shown with reference to FIG. 4, a support arm 31, and a seat 32.

Figure 2:
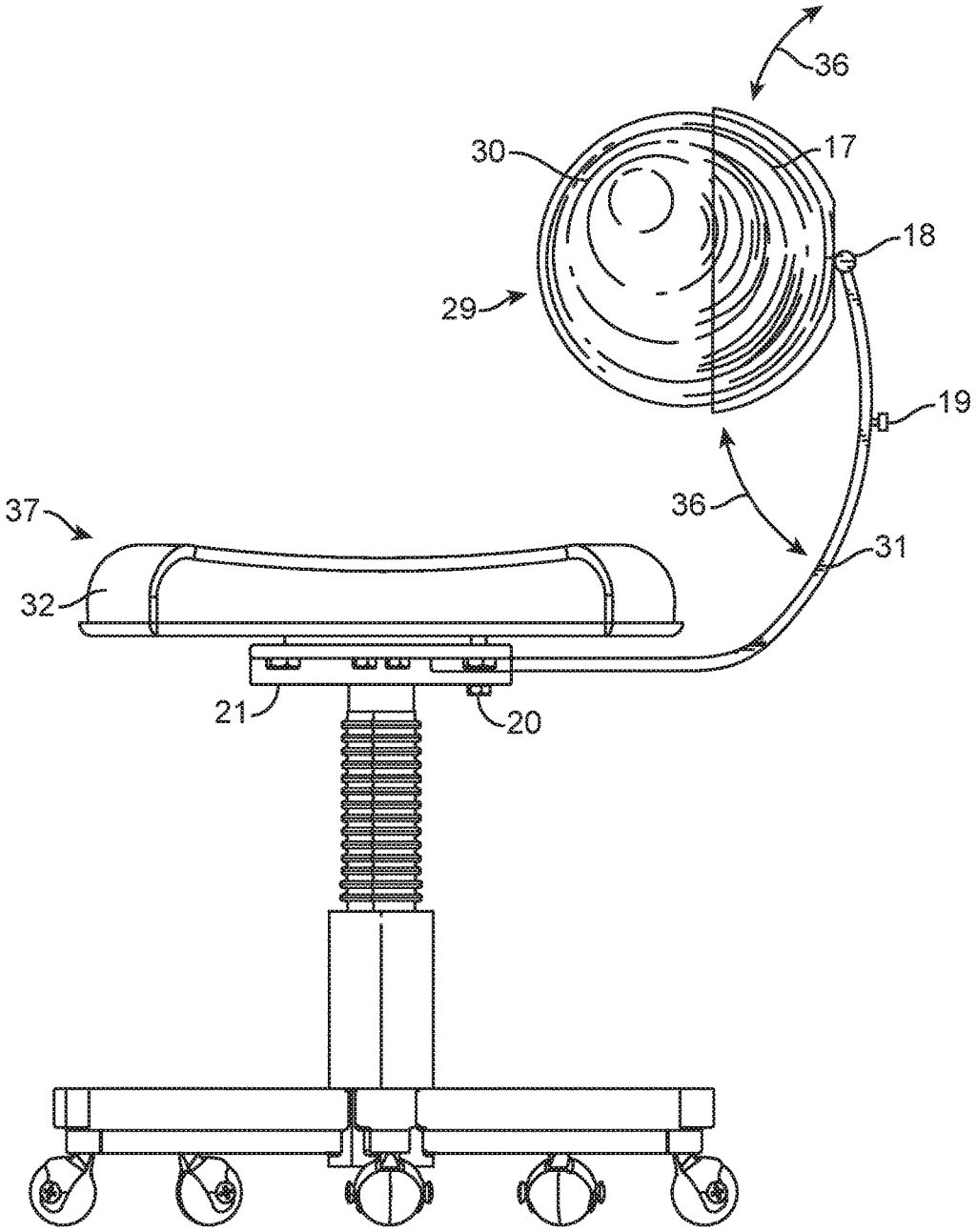
FIG. 2 is a left side view of a seating device backrest according to a preferred embodiment of present invention.

Referring now to FIG. 2, the seating device backrest 29 further comprises a receptacle connection member 18, a support arm connection member 20 (e.g., locking pin), and seating device mount 21. In operating, the support arm 31 may be elongated utilizing two telescopically aligned members that lock in place by means of a support arm 31 telescopic extension lock pin 19 allowing the backrest 29 to adjust the situs at which the convex body 30 makes contact with the desired concave section of a seat occupant's spinal lumber and/or thoracic regions.

The lock pin 19 is configured to lock the support arm 31 in a position, and may comprise a screw or spring-triggered pin with a handle, a knob, or other similar latching device that, when activated or manually adjusted, allows the adjustment and locking of the relative position of the telescopically aligned members of the support arm 31. Similarly, the horizontal distance the backrest 29 moves toward or away from the seat occupant may be adjusted using the support arm connection member 20, which may comprise a separate adjusting pin mechanism embedded in the seating device mount 21 where it makes contact with support arm 31. The mechanism by which the support arm 31 fixedly connects to the seating device connection mount 21 may take various forms such as, but not limited to, inserting the extremity of the support arm 31 into a channel that is form fitted to receive it, and which allows the lock pin 20 or other mechanism to stabilize its position.

Figure 8:
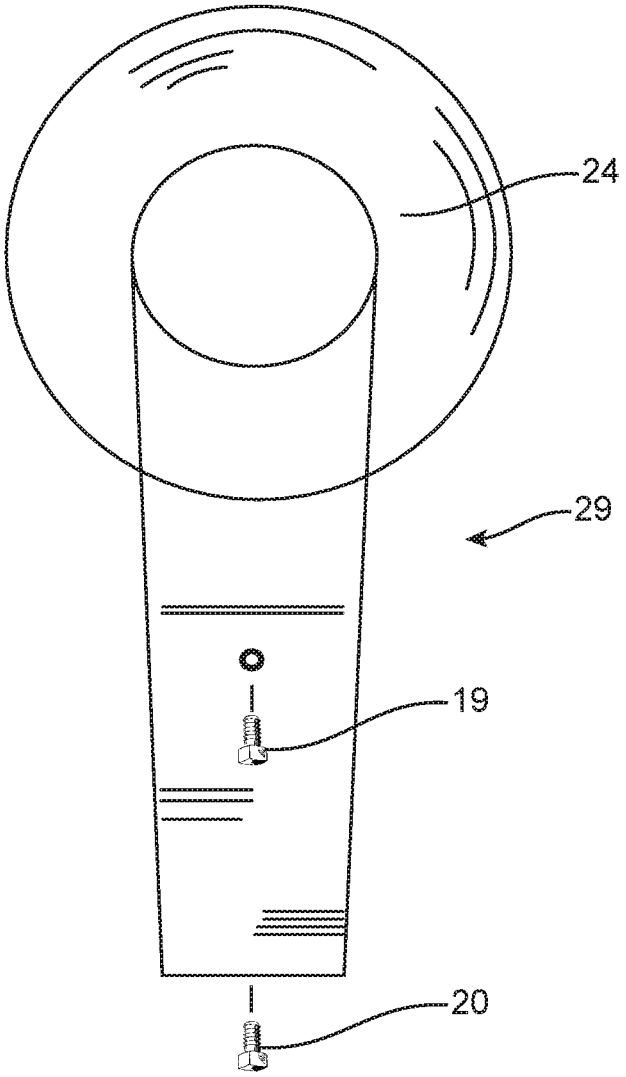
FIG. 8 is a back facing view of a seating device backrest according to an optional embodiment of the present invention.

Referring still to FIG. 2, the connecting element 18 may comprise metal or other similarly rigid material, and joins the mounting receptacle 17 to a rigid support arm 31. The connecting element 18 could be provided with a hinge feature or other radial adjustment component enabling the mounting receptacle 17 to rotate vertically 36 relative to the connecting element 18 or, in an optional embodiment, as shown in FIG. 8, the connecting element 18 may be preferably rigid maintaining the mounting receptacle 17 in a static position relative to the connecting element 18 and the support arm 31. Optionally, the connecting element 18 may have a locking mechanism which holds a desired position of the connecting element 18 relative to the mounting receptacle 17 and the support arm 31.

A separate connecting member 20 joins the support arm 31 to a seating device 37 connection mount 21 fixedly connected to the bottom of a seat cushion or other element of a seating device 37 seat 32. The seating device connection mount 21 is preferably made of metal or other similarly rigid and durable material, and is connectedly fixed to the bottom of the seating device seat cushion 32 by means of screws, bolts, rivets, or other similar attachment mechanisms.

Figure 3:
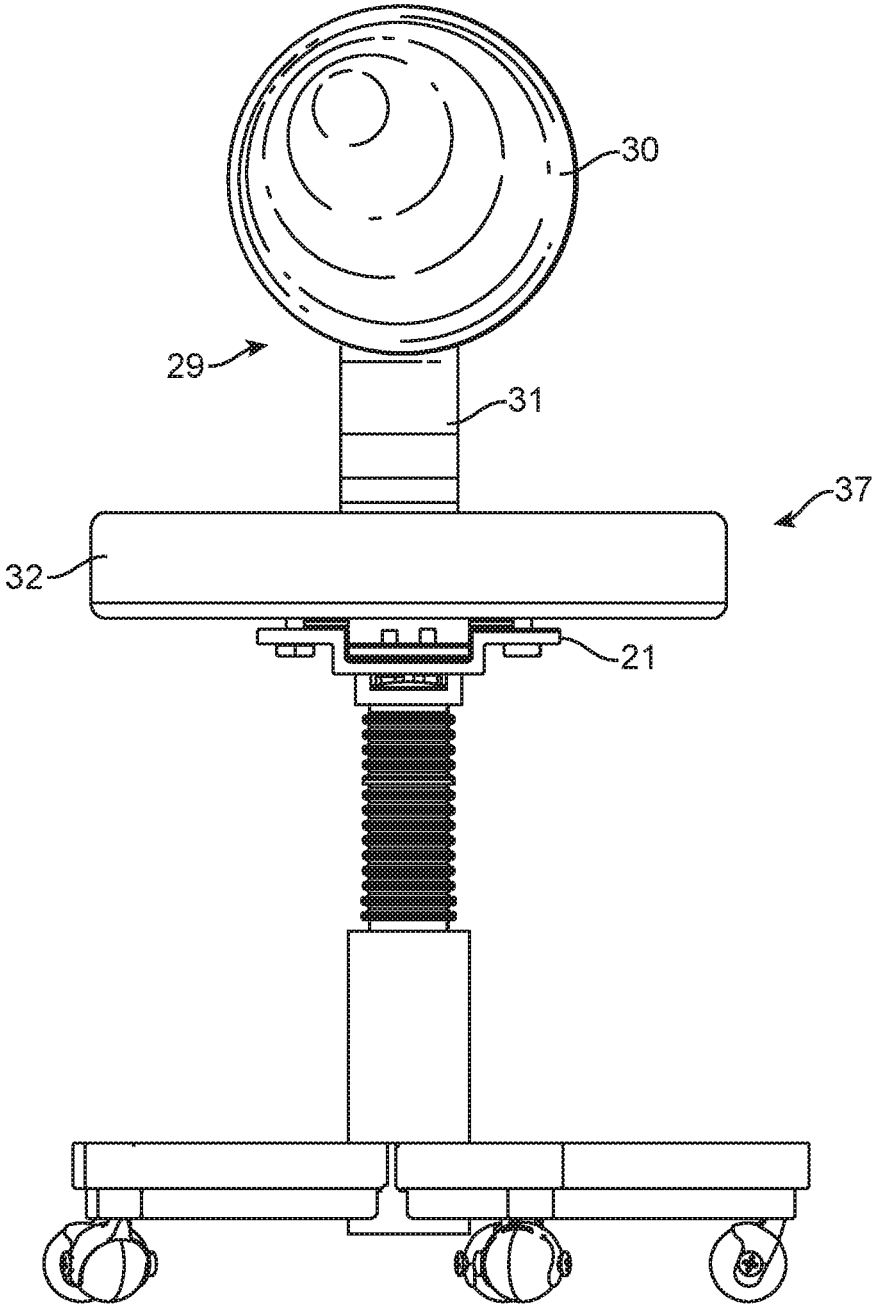
FIG. 3 is a front-facing, view of a seating device backrest according to a preferred embodiment of the present invention.

With reference now to FIG. 3, a front-facing view of a seating device 37 and seating device backrest 29 according to a preferred embodiment of the present invention is shown in which the body 30, a mounting receptacle 17, only the edge being shown, the receptacle being more clearly shown with reference to FIG. 4, a support arm 31, and a seat 32 are shown.

Referring now to FIG. 4, an exploded perspective view of a seating device backrest 29 according to a preferred embodiment of the present invention is shown. As illustrated in FIG. 4, the mounting receptacle 17 in some embodiments, is substantially semi-spherical with an opening into which the spherical body 30 may be inserted. In particular, the mounting receptacle 17 is substantially semi-spherical from the opening side progressing backward toward the section at which it makes contact with the connecting element 18, at which point it may take a spherical, flat or other shape to facilitate fixation to the connecting element 18. In optional embodiments, the mounting receptacle 17 may be any other useful shapes such as oval, square or rectangular, as further examples, and may comprise a solid, porous or grate/lattice-like structure.

The mounting receptacle 17 is preferably comprised of rigid material including, but not limited to, steel, industrial grade composite plastics, carbon fiber, aluminum or iron, each being sufficiently rigid and strong enough to counter balance and bear from the rear the a plurality of directional pressure vectors a seat occupant's body weight and muscle movements may apply directly to the body 30 at a plurality of points along any one of its given convex hemispheres.

The body 30 preferably comprises at least an inflated pneumatic, or liquid or solid-filled, compressible body with seat occupant facing surface being substantially spherical and otherwise convex prior to compression by a seat occupant's back. In various embodiments of the present invention, the body 30 may have at least one portion that is not convex in order to facilitate fixation into the mounting receptacle 17.

The outer shell of the body 30 is preferably made of expandable or inflatable material that may be rubber, silicone, plastic or other similarly flexible material, and in preferred embodiments may be pressure-filled and sealed with (a) one or more liquids, such as water, (b) one or more gases, such as carbon dioxide, and/or (c) one or more single or aggregate solids, such as silicone gel, sponge, padding, rubber, feathers, foam material, or a combination thereof.

When seated and pressing primarily the center spinal lumbar/thoracic back regions against the convex body 30, a seat occupant's optimally concave spinal lumbar and/or thoracic regions make contact, as desired, with the body's 30, and elastic sheath's 23, convex protruding surface. In various embodiments of the present invention, the elastic sheath 23 may be covered for utilitarian purposes with rubber, foam, cloth, leather, vinyl, fabric, or cushion-like materials to provide comfort and increase surface tension to better enable stability and adhesion of the contact between the seat occupants' back and the backrest 29 generally.

Figure 6:
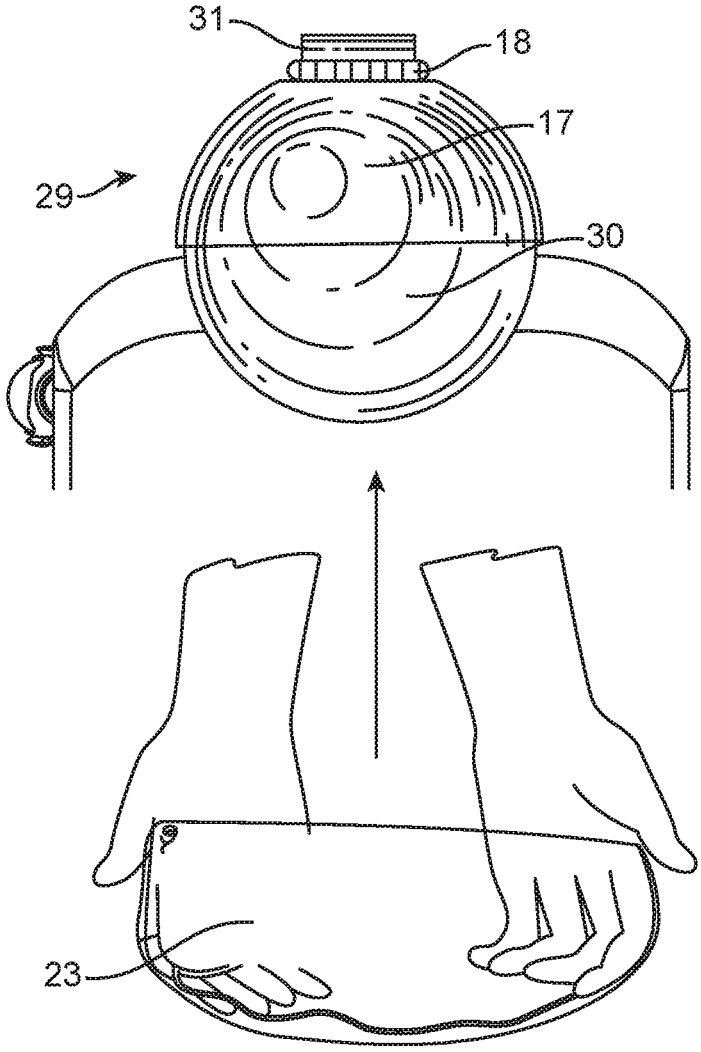
FIG. 6 is a top view of a seating device backrest according to a preferred embodiment of the present invention depicting at least one method of attaching the backrest convex member to the mounting receptacle.

As illustrated in FIGS. 4 and 6, in a preferred embodiment of the present invention, the diameter of the body 30 is approximately equal to the diameter of the circular opening of the mounting receptacle 17. In a preferred embodiment of the present invention, the diameter of the body 30 and the diameter of the circular opening of the mounting receptacle 17 will be approximately 1 foot, yet optional embodiments of the backrest 29 may be provided with a body 30 and corresponding mounting receptacle 17 that have diameters that are greater or less than 1 foot in order to provide various-sized seat occupants with optimal and healthy spinal lumbar/thoracic support.

Figure 15:
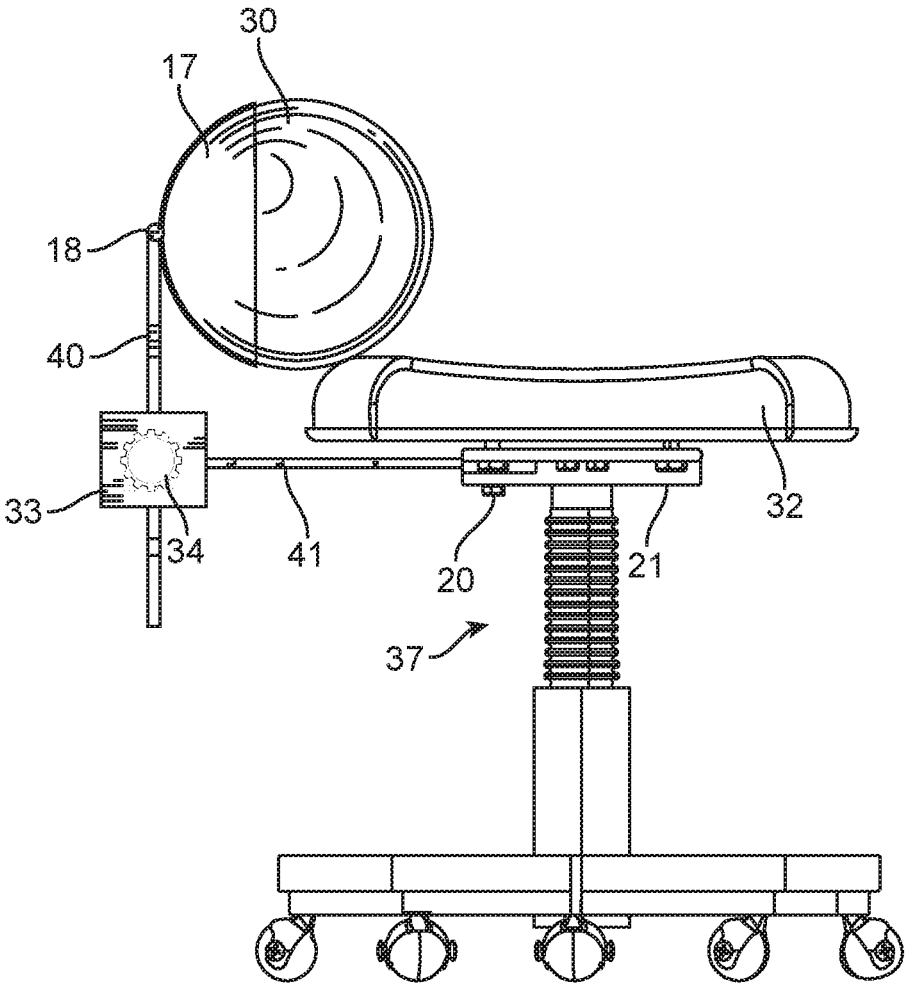
FIG. 15 is a right side view of the seating device backrest according to an optional embodiment of the present invention.
Figure 16:
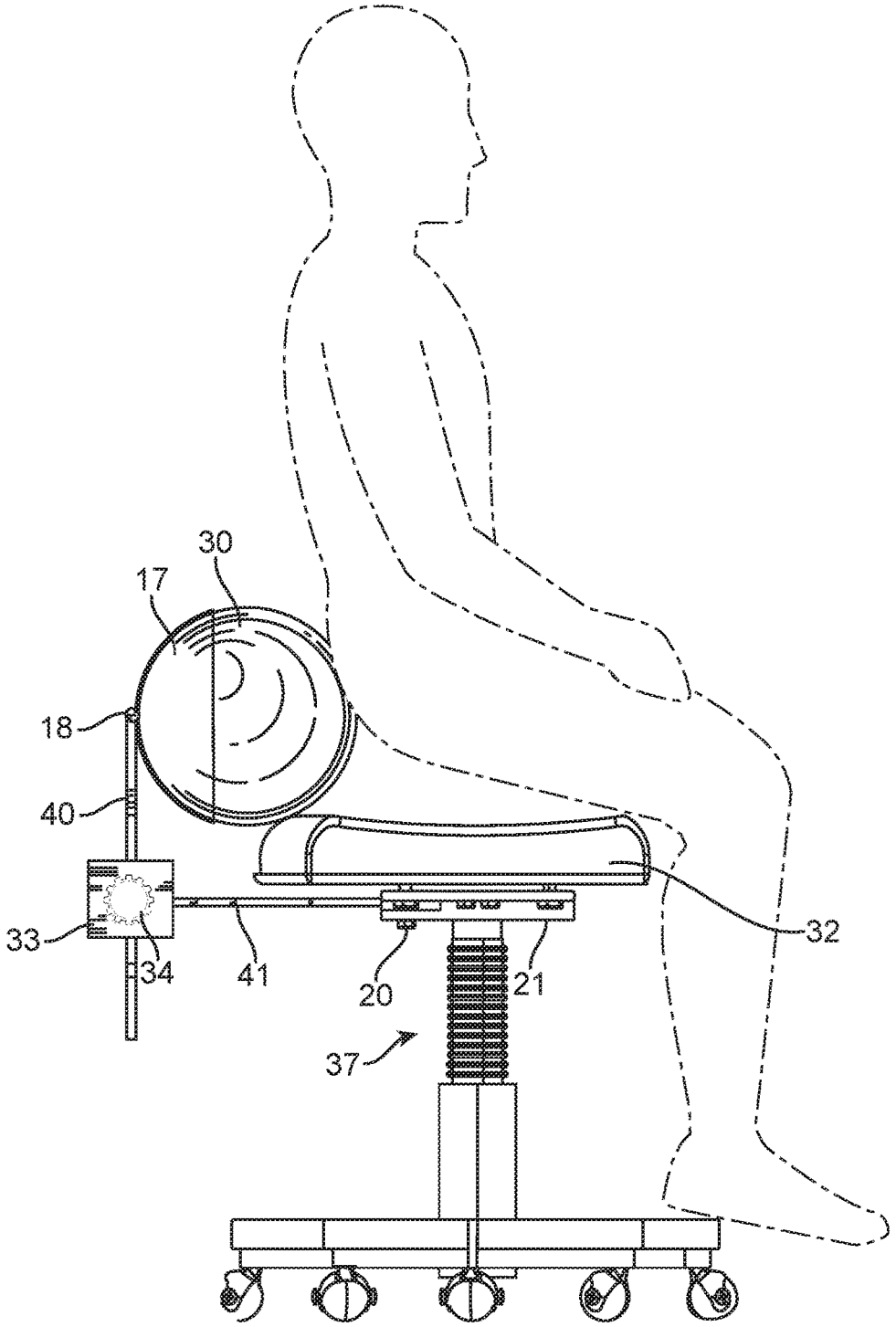
FIG. 16 is a right side view of the seating device backrest with seat occupant according to an optional embodiment of the present invention.

Referring now to FIGS. 15-16, in an optional embodiment backrest 29 and seating device 37, when the backrest 29 is lowered to a lowest point at which it makes contact with the top of seating device's 37 horizontal seat 32, it enables a seat occupant to place their gluteal buttocks, and sacral spinal, regions on or abutted against, without limitation, the upper forward-facing quadrant of the backrest 29 lifting the sacral spinal and gluteal buttocks regions into an upward angle relative to the seat 32 thereby providing upright balance and maneuvering a seat occupant's spine and back muscles in to optimal alignment.

Once inserted into the mounting receptacle 17, the body 30 may be inflated or deflated by means of an inflation valve 28 that enables injection of varying amounts of preferred materials, such as liquids, gases or solids, to provide a stabilized yet conforming compression resistance bearing on a seat occupant's spinal lumbar/thoracic regions as desired. The inflation valve 28 allows liquids, gasses or solids to pass through the valve 28 when punctured with an inflation needle, and prevents such liquids, gasses or solids from escaping once the inflation needle is removed. The body 30 may also be constructed with no inflation valve 28, whereby the liquids, gases or solids are sealed, zippered, sewed or otherwise permanently or semi-permanently contained inside the shell of the body 30.

Figure 5:
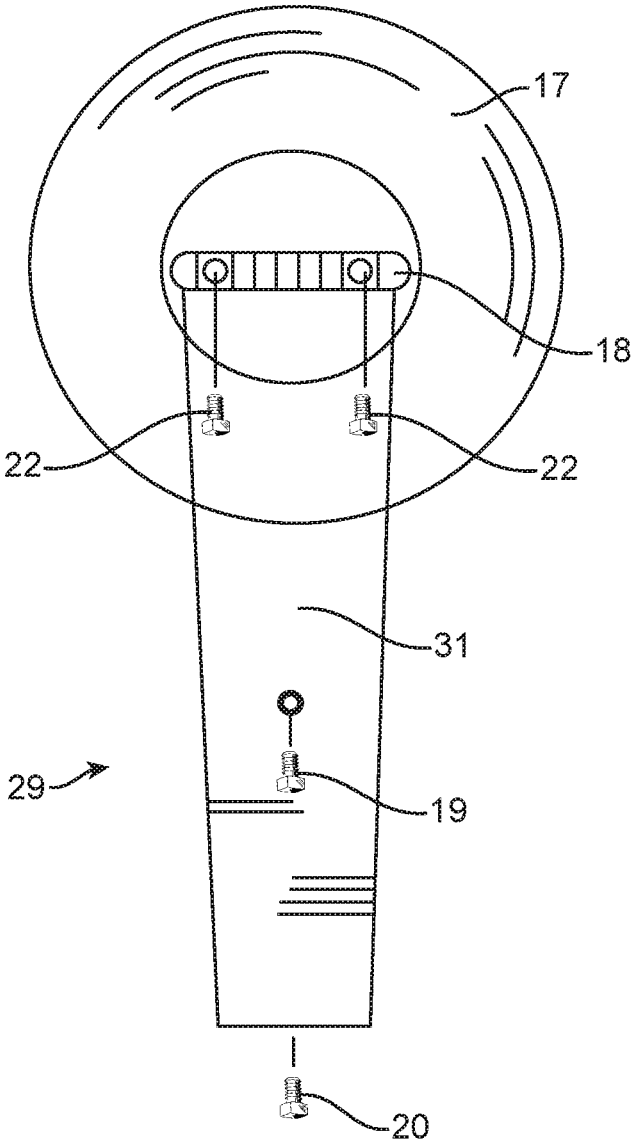
FIG. 5 is a rear facing view of a seating device backrest according to a preferred embodiment of the present invention.

As illustrated in FIGS. 4 and 5, in an embodiment of the present invention, the connecting element 18 is fixedly connected to the mounting receptacle 17 using one or more fasteners 22 that may preferably comprise screws and bolts, rivets, rubber pins, nails, hooks, or other similarly operable fastening devices. Other connecting elements 18 that allow for easy replacement may be used as well, much as snaps or turn fasteners.

The support arm 31 may be arched as illustrated in FIGS. 2 and 4, or take other shapes including, without limitation, a right angle formed by a horizontal component fixedly attached by a connecting element 20 to the seating device connection mount 21, and a vertical component fixedly attached by a connecting element 18 to the mounting receptacle 17. The support arm's plurality of portions 31, 40, 41 may comprise rigid materials preferably, but not limited to, steel, industrial grade composite plastics, carbon fiber, aluminum or iron, sufficiently rigid and strong to bear the weight pressure of a seat occupant's movements, and the horizontal backward pressure a seat occupant may apply to the backrest 29. The support arm 31, 40, 41 may comprise one member or multiple rigid interconnected members or portions including, for instance, parallel rods or cylindrical or other shaped bars of varying widths, heights, diameters.

Referring now to FIG. 6, in an embodiment of the backrest 29 according to the present invention, the spherical body 30 may be fixedly connected with and into a mounting receptacle 17 by means of an elastic sheath 23 that adheres to and connects the body 30 and mounting receptacle 17. The elastic sheath 23 serves the purpose of applying an elastic and adhesive pressure force to both the surface of the body 30 and the outer portion of the mounting receptacle 17.

The elastic sheath 23 may be constructed of rubber, silicone, plastic or other similarly flexible elastic materials that stretch and will adhere through elastic contraction pressure to the outer portion of the body 30 and the mounting receptacle 17. Optionally, the body 30 may be fixedly connected into the mounting receptacle 17 by means of adhesives, glues, cements, straps, screws, magnets, Velcro®, or other similar means of permanent or semi-permanent connection.

Figure 7:
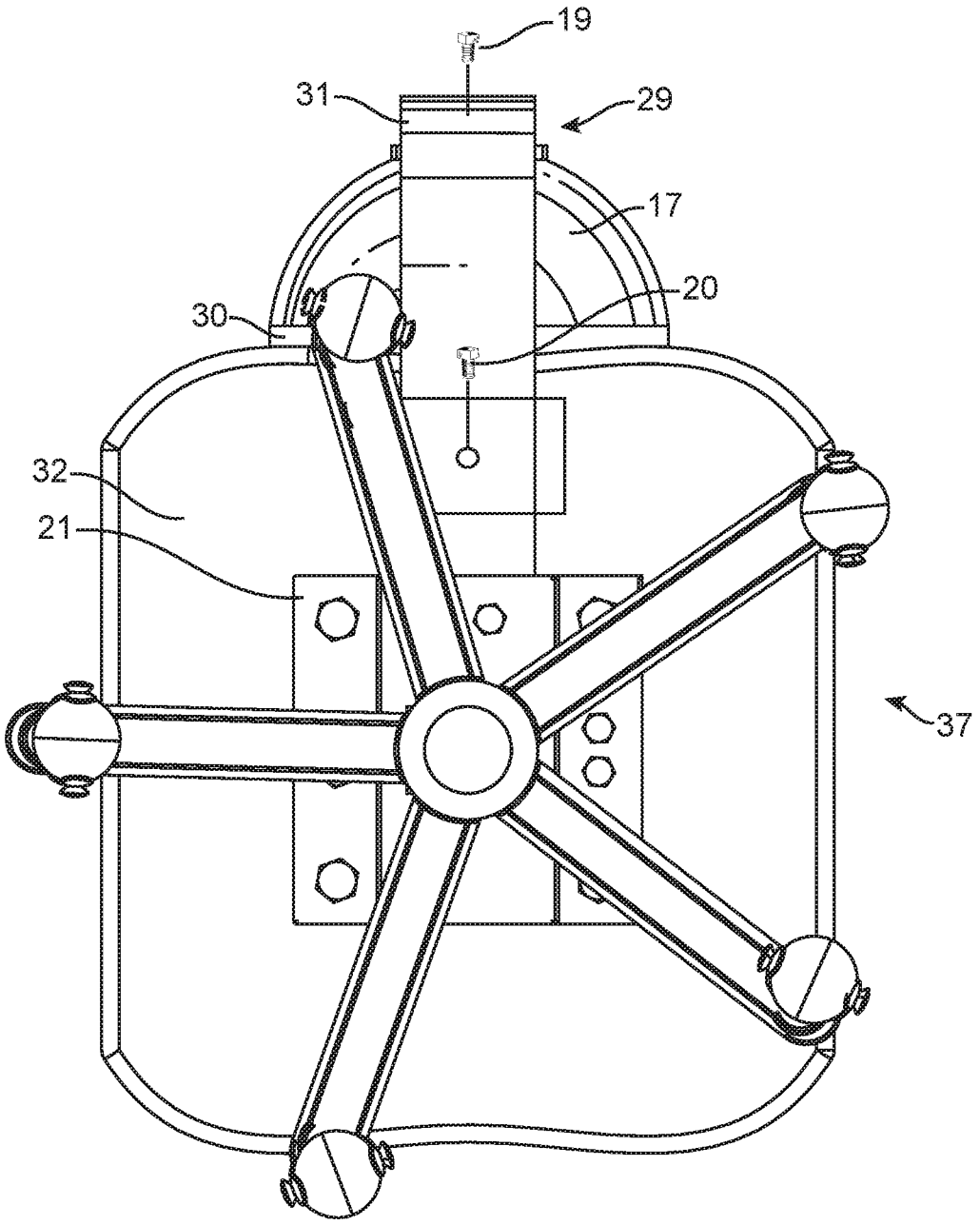
FIG. 7 is a bottom facing view of a seating device backrest according to a preferred embodiment of the present invention.

FIG. 7 depicts a bottom facing view of a seating device 37 and seating device backrest 29 according to a preferred embodiment of the present invention which shows a connecting element 20 and the seating device connection mount 21.

FIG. 8 and FIGS. 9-11(*a*)-(*b*) depict optional embodiments of the present invention. Details corresponding to those described previously are designated with the same numerical references with the exception of those invention elements that differ from the previous embodiment depicted in FIGS. 1-7. All elements described above with respect to the preferred embodiment of the present invention shall, to extent not inconsistent with details provided below, be deemed to be part of the optional embodiments.

FIG. 8 depicts an optional embodiment of the present invention wherein the support UM 31 and the mounting receptacle 17 comprise a single combined support structure 24 with no intermediary connecting element 18.

Figure 9:
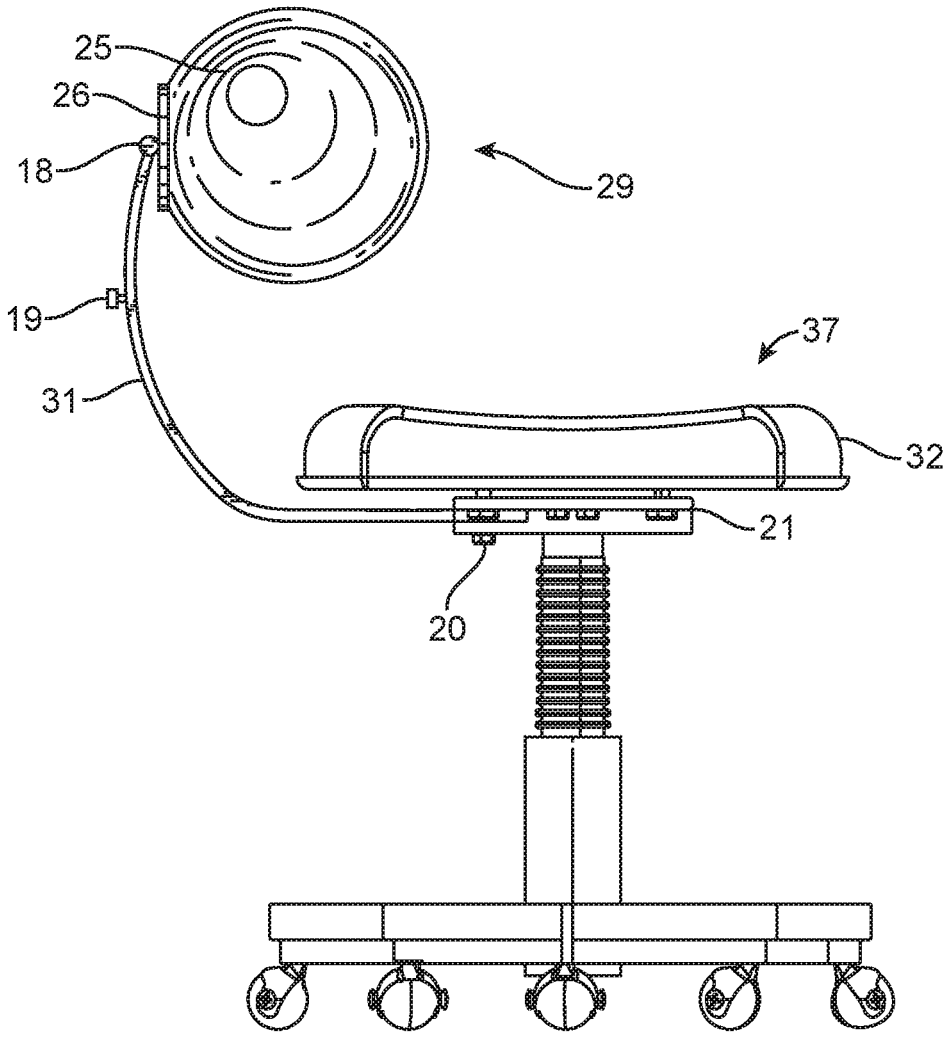
FIG. 9 is a side facing view of a seating device backrest according to an optional embodiment of the present invention.
Figure 10:
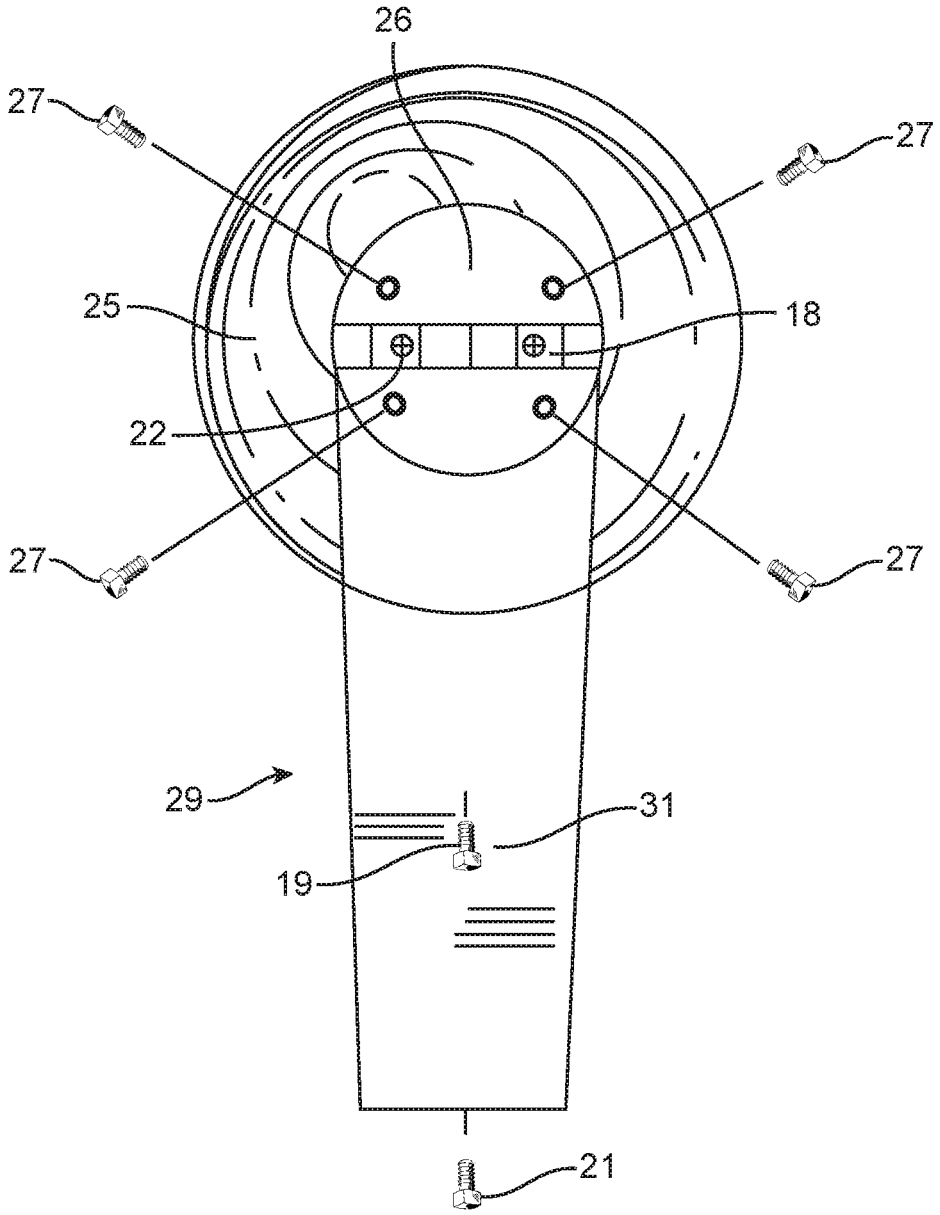
FIG. 10 is a back facing view of an optional embodiment of the present invention.
Figure 11A:
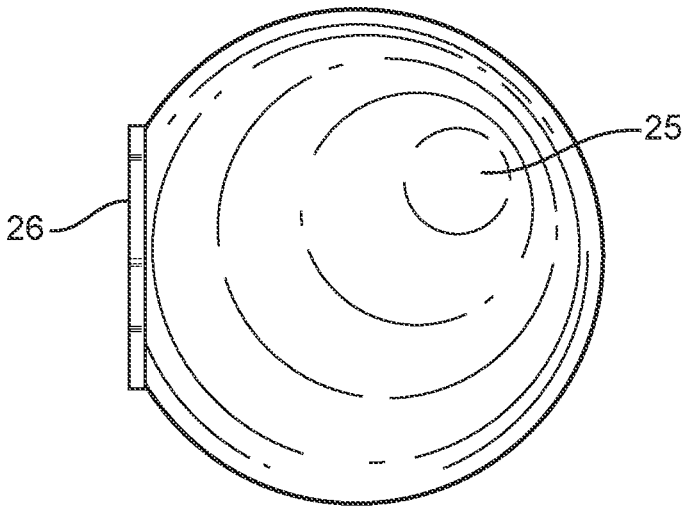
FIG. 11(*a*) is a side facing view of various components of a spherical body of an optional embodiment of the present invention.
Figure 11B:
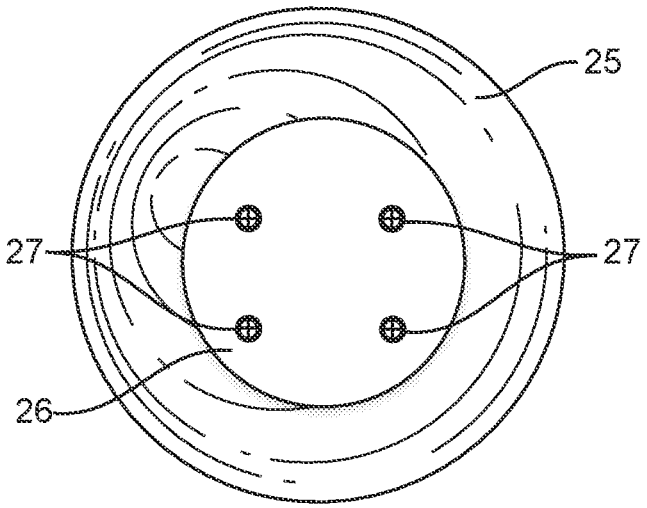
Figure 12:
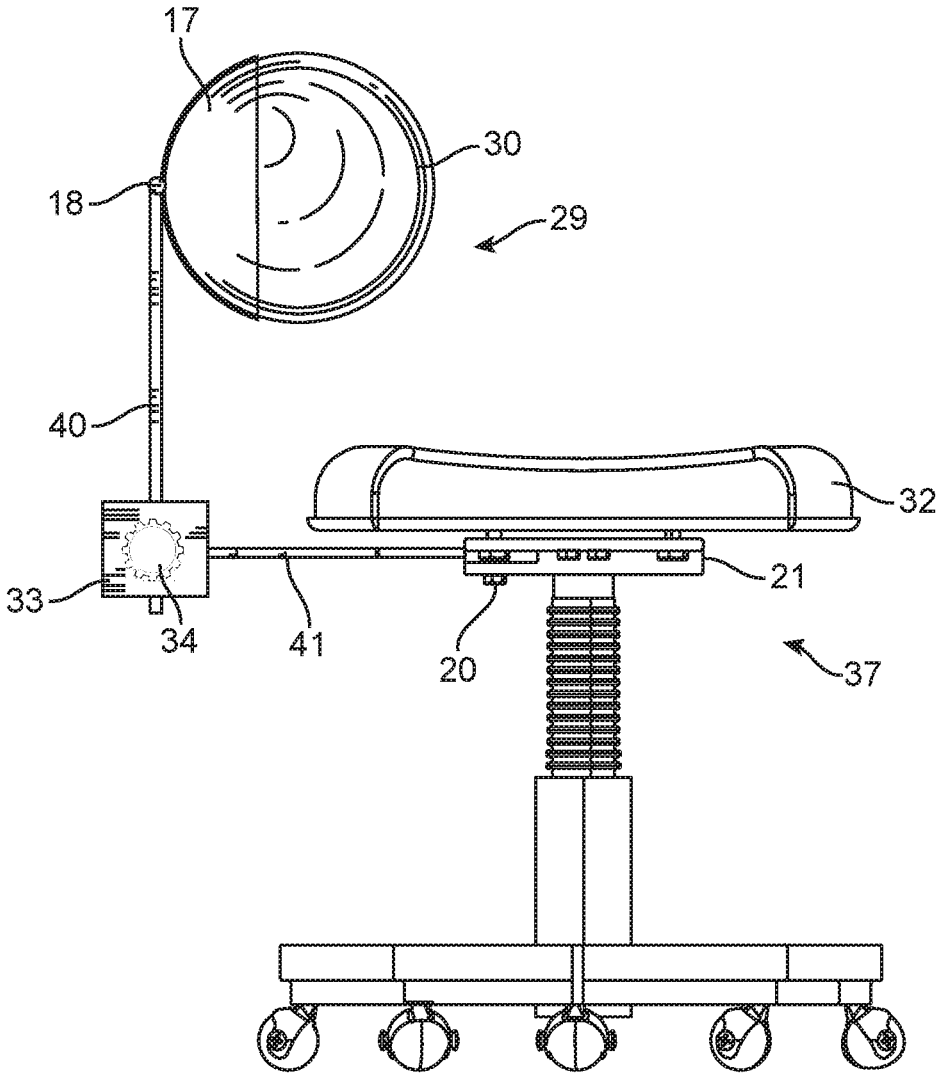
FIG. 12 is a right side facing view of a seating device backrest according to an optional embodiment of the present invention.
Figure 13:
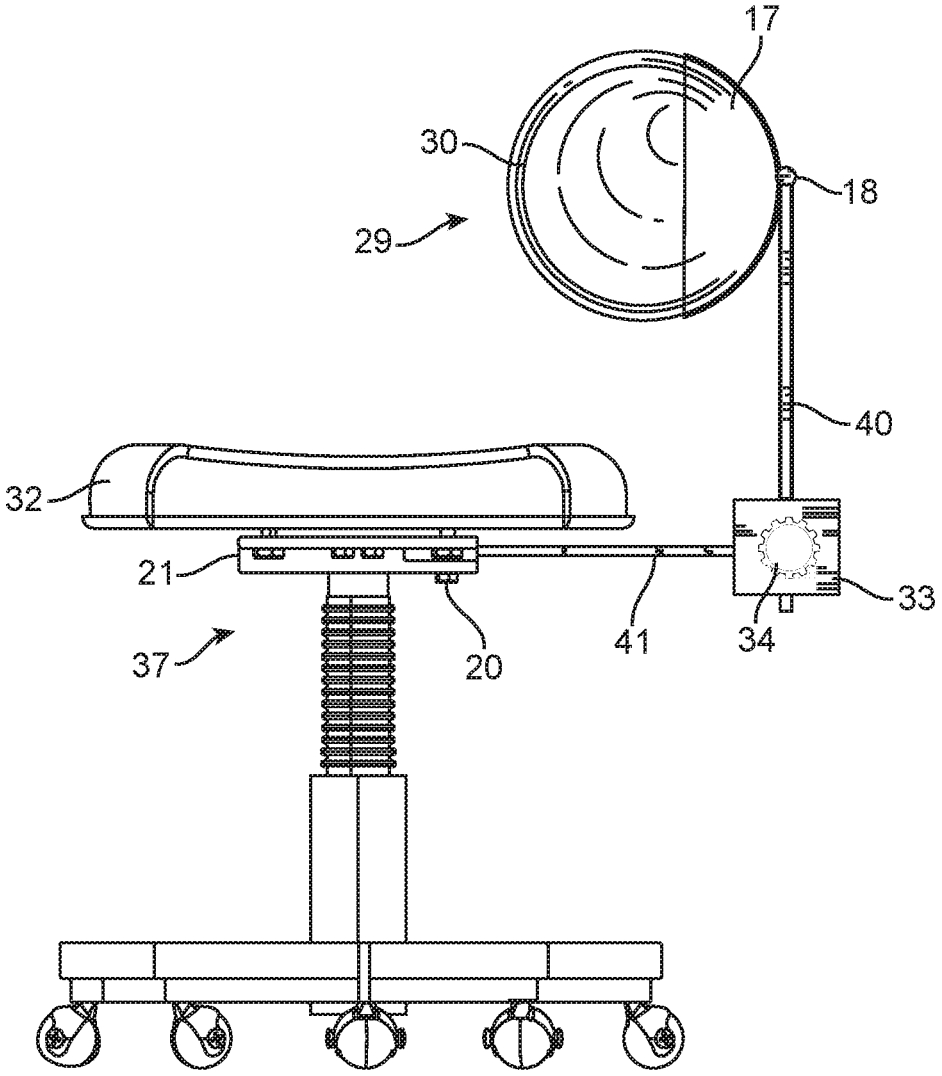
FIG. 13 is a left side facing view of a seating device backrest according to an optional embodiment of the present invention.
Figure 14:
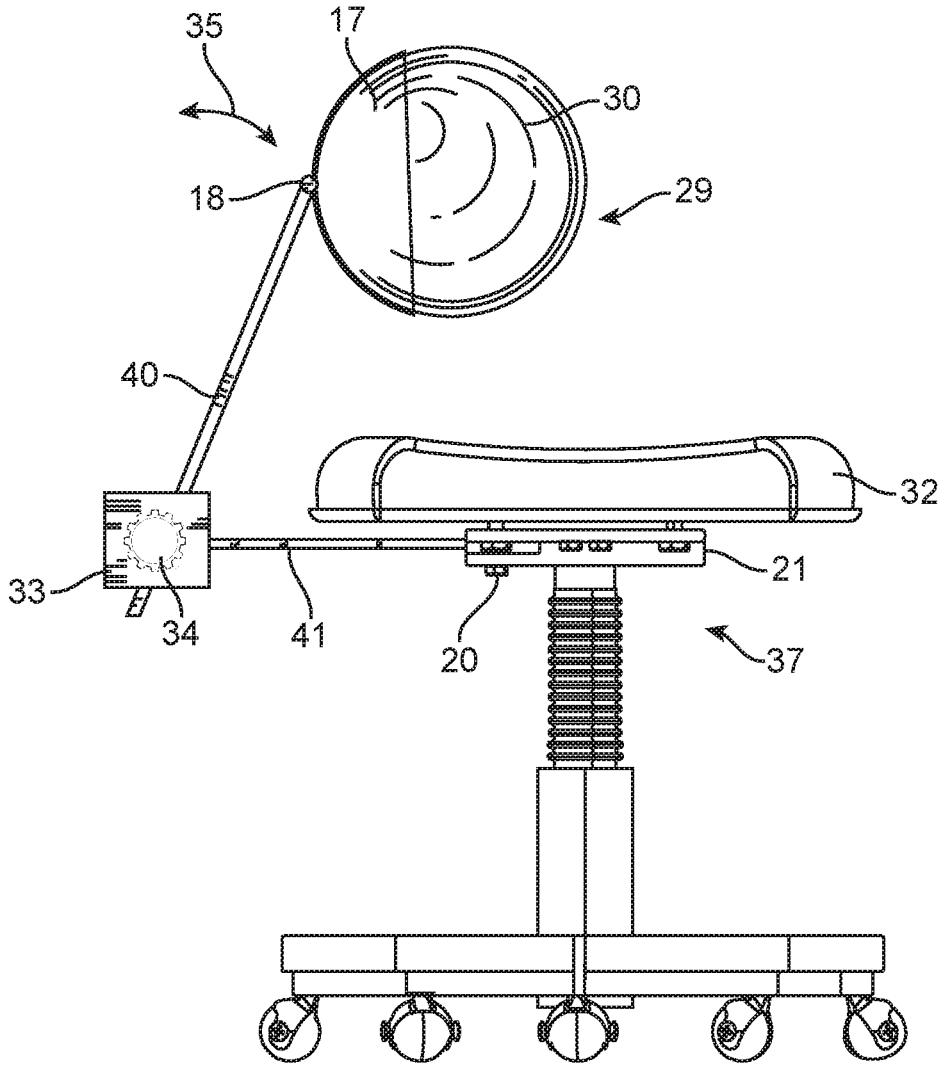
FIG. 14 is a right side view of the seating device backrest according to an optional embodiment of the present invention.

FIGS. 9-11(*a*)-(*b*) depict an optional embodiment of the present invention wherein a spherical body 25 with one substantially flat side is fixedly connected to a support panel 26. The support panel 26 provides stability for, and is fixedly connected to, one side of the spherical body 25. The support panel 26 is fixedly connected to the support arm 31 by means of a connecting element 18 and fasteners 27. The fasteners 27 preferably comprise screws and bolts, rivets, rubber pins, nails, hooks, snaps, turn fasteners or other similarly operable fastening devices, fixedly connect the support panel 26 to a version of the body 25 configured to fixedly connect with the support panel 26 after being inserted into threaded holes or other matching latches or grooves provided in the flat or amenable shaped back side of the body 25. The support panel 26 may be manufactured from metal, wood, carbon fiber, plastic or similarly rigid material, and may also be fixedly connected to the spherical body 25 by means of adhesives, cements, straps, magnets, clamps, Velcro®, or other similar means of permanent or semi-permanent connection. Optionally, FIGS. 9-11(*a*)-(*b*) depict an optional embodiment of the present invention wherein a body 25 with one substantially flat side is fixedly connected to a support panel 26. The support panel 26 provides stability for, and is fixedly fixed to, one side of the spherical body 25. The support panel 26 is fixedly connected to the support arm 31 by means of a connecting element 18 and fasteners 27.

The optional embodiment of the present invention depicted in FIGS. 9-11(*a*)-(*b*) may comprise a substantially spherical body 25 without a flat side with its substantially concave back side being fixedly connected to a substantially convex side of a support panel 26 that is substantially semi-spherical.

Referring now to FIGS. 12-16, the seating device 37 may further comprise a support arm with a plurality of portions 40, 41 and a bearing 33 between a first and second portions of the support arm 40, 41. The bearing 33 is configured to provide for free linear movement in a forward or backward direction, such that the body 30 and backrest 29 move rotationally with respect to the seat 32, and achieve manipulated rotation around a fixed axis. The bearing 33 may comprise a pivot hinge or other similar mechanism to mount and stabilize the plurality of portions of the support arm 40, 41 in one site. If more degrees of freedom are required, the bearing 33 may comprise a ball hinge and the like. An adjuster 34 is also provided to change the angle of the body 30 and backrest 29 by providing motive force to one or more portions of the support arm 40, 41. Furthermore, the height of the receptacle 17 may be adjusted by using the adjuster 34 thereby allowing a seat occupant to control the height of the backrest 29 for a specific body size, and modulate the locus at which the spinal lumbar/thoracic regions' preferred concave shape makes contact with the selected convex member hemisphere or seat occupant facing section of the backrest 29. Referring to FIG. 16, by lowering the backrest 29 into its lower positions resting at or immediately adjacent to the seat 32, this optional embodiment of the present invention enables a seat occupant to place their gluteal buttocks and spinal sacral regions at a plurality of positions abutting, or on top of, the forward-facing upper quadrant of the backrest 29 thereby lifting the spinal sacral and gluteal buttocks regions into an upward angle relative to the seat 32 providing upright balance and maneuvers a seat occupant's spine and back muscles into optimal postural alignment.

The combined shape, construction and operation of the various embodiments of the seating device 37 and seating device backrest 29 provide for functional and beneficial advantages for a seat occupant that are not found in the prior art. By providing a seating device 37 and seating device backrest 29 in accordance with the present inventions, numerous advantages are realized. A person sitting in a seating device 37 with a spherical backrest 29 is able to sit in comfort over extended periods of time and maintain proper posture with little or no pressure being placed on the delicate spinal lumbar/thoracic muscles, and has little or no option other than to make contact with the convex apex of the convex body 25, 30, which in the present inventions are the only back support option. The seating device 37 and backrest 29 and their associated parts, connections and mechanisms featured in the various embodiments of the present inventions: (a) increase a seat occupant's comfort by introducing a more healthy spinal lumbar/thoracic pressure mechanism to maintain proper sitting posture while also greatly reducing or otherwise eliminating the contact pressure applied to the sensitive muscular lumbar regions of a seat occupant's back; (b) allow 360 degree rotation of a seat occupant's spinal lumbar/thoracic region around the pivot formed where the optimally concave spinal column region meets the convex surface of the body 13, 25 comprising the primary contact point between the seat occupant and the backrest 29; (c) effectively eliminate the seat occupant's options to "cheat" by slouching their back onto comfortable backrest elements other than the lumbar supportive elements; and (d) enable a seat occupant to comfortably stabilize their gluteal buttocks, and sacral spinal, regions on the upper forward-facing quadrant of the backrest 29 placed in its lowest position abutting the seat 32, which in turn lifts the sacral spinal and gluteal buttocks regions into an upward angle relative to the seat 32 providing upright balance and maneuvering a seat occupant's spinal and muscular back regions into an optimal, healthy and comfortable alignment. The present invention's 360-degree rotation flexibility allows a seat occupant to make thousands of adjustments of their back's optimally concave spinal lumbar/thoracic region above, around, and below the convex body 30, 25 in a manner not present with seating device backrests and lumbar backrest attachments in the prior art.

While the foregoing written description of the present invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiments, methods, and examples, but by all embodiments and methods within the scope and spirit of the invention as claimed.

It is to be understood that the above-referenced embodiments are only illustrative of the application for the principles of the present invention. Numerous modifications and optional embodiments can be devised without departing from the spirit and scope of the present invention. While the present invention has been shown in the drawings and described above with particularity and detail in connection with what is presently deemed to be the most practical and preferred embodiments of the invention, it will be apparent to those of ordinary skill in the art that numerous modifications can be made without departing from the principles and concepts of the invention as set forth herein. Those modifications are to be deemed within the scope of the present invention. Lastly, reference to optional embodiments are not mutually exclusive with the other embodiments described herein.

What is claimed is:

1. A seating device backrest comprising:

a mounting receptacle configured to accept a convex body, wherein the mounting receptacle mounting is a substantially semi-spherical;

a fixation member disposed on or through an internal surface of the mounting receptacle, wherein the fixation member is configured to facilitate coupling of the convex body;

wherein the fixation member is disposed on or through an internal surface of the mounting receptacle comprises an aperture dimensioned to accept a fastener, the fastener being configured to mate with the convex body.

2. The seating device backrest of claim 1, further comprising a support atm coupled to the mounting receptacle and configured to position the mounting receptacle at an angle such that the convex body makes focal contact at an occupant's concave lumbar or thoracic spinal region.

3. The seating device backrest of claim 2, wherein the first bearing comprises a radial adjustment hinge enabling the mounting receptacle and spherical body to rotate vertically relative to the occupant's seating position.

4. The seating device backrest of claim 1, wherein the support arm comprises a first bearing at a first end, configured to provide occupant adjustable angular and rotational movement to the mounting receptacle, and at least a first locking member for securing the mounting receptacle in place.

5. The seating device backrest of claim 1, wherein convex body is substantially spherical, and is configured to provide support to a seat occupant's optimally concave lumbar or thoracic spinal region.

6. The seating device backrest of claim 1, further comprising a convex body fixedly connected with and into the mounting receptacle using an elastic sheath that adheres to and connects the spherical body and mounting receptacle.

7. The seating device backrest of claim 6, wherein the convex body is inflatable or deflated and comprises an inflation valve which enables injection of varying amounts of material to provide for predetermined compression of the convex body.

8. The seating device backrest of claim 1, wherein the support arm comprises a first portion and a second portion, the second portion being coupled to the receptacle, and wherein the backrest further comprises:

a second bearing for coupling the first and second portions, wherein the second bearing is configured to provide rotational motion and vertical motion to the second portion;

an adjuster coupled with the bearing, and configured to provide motive force to adjust the height of the convex member and angle of the convex member to modulate the locus at which the spinal concave shape makes contact with the convex member.

9. A seating device comprising:

a seat portion dimensioned for an occupant;

a support arm coupled to seat portion proximate a first end of the support arm;

a mounting receptacle coupled to the support arm proximate a second end of the support arm, wherein the mounting receptacle is configured to accept a substantially convex body, wherein the mounting receptacle mounting is a substantially semi-spherical;

a fixation member disposed on or through an internal surface of the mounting receptacle, the fixation member configured to facilitate coupling of the convex body;

wherein the fixation member disposed on or through an internal surface of the mounting receptacle comprises an aperture dimensioned to accept a fastener, the fastener being configured to mate with the convex body;

wherein the support arm is configured to position the mounting receptacle at an angle such that the convex body makes focal contact at a seat occupant's optimally concave lumbar or thoracic spinal region.

10. The seating device of claim 9, wherein the support arm comprises a first bearing at a first end configured to provide occupant adjustable angular and rotational movement of the mounting receptacle, and a locking member for securing the mounting receptacle in place.

11. The seating device of claim 9, further comprising a convex body that is substantially spherical, and is configured to provide support to a seat occupant's optimally concave lumbar or thoracic spinal region.

12. The seating device backrest of claim 11, wherein the convex body is fixedly connected with and into the mounting receptacle using an elastic sheath that adheres to and connects the spherical body and mounting receptacle.

13. The seating device of claim 9, wherein the convex body is inflatable or deflated and comprises an inflation valve which enables injection of varying amounts of material to provide compression.

14. The seating device of claim 9, wherein the first bearing comprises a radial adjustment hinge enabling the mounting receptacle and spherical body to rotate vertically relative to the occupant's seating position.

15. The seating device of claim 9, wherein the support arm comprises a first portion and a second portion, the second portion being coupled to the receptacle, and wherein the backrest further comprises:

a second bearing for coupling the first and second portions, wherein the second bearing is configured to provide rotational motion and vertical motion to the second portion;

an adjuster coupled with the bearing, and configured to provide motive force to adjust the height of the convex member and angle of the convex member to modulate the locus at which the spinal concave shape makes contact with the convex member.

* * * * *